US005467955A

United States Patent [19]

Beyersmith

[11] Patent Number: 5,467,955

[45] Date of Patent: Nov. 21, 1995

[54] ANTENNA MOUNTING PLATFORM FOR A MONOPOLE TOWER

[75] Inventor: Stacy C. Beyersmith, Tucker, Ga.

[73] Assignee: Bellsouth Corporation, Atlanta, Ga.

[21] Appl. No.: 282,279

[22] Filed: Jul. 28, 1994

[51] Int. Cl.[6] ..... H01Q 1/12

[52] U.S. Cl. ..... 248/219.3; 108/144; 248/230.1; 343/890

[58] Field of Search ..... 248/121, 125, 248/219.3, 225.31, 230, 245; 108/144; 343/879, 890, 891

[56] References Cited

U.S. PATENT DOCUMENTS

| | | | |
|---|---|---|---|
| 2,707,034 | 4/1955 | Hetrick | 343/890 X |
| 2,761,643 | 9/1956 | Ward et al. | 248/230 |
| 2,844,819 | 7/1958 | Andrews | 343/890 X |
| 2,899,764 | 8/1959 | Oberlin, Jr. | 248/230 X |
| 3,003,646 | 10/1961 | Wolf | 248/230 X |
| 3,318,561 | 5/1967 | Finke et al. | 248/230 X |
| 3,530,996 | 9/1970 | Schaffer | 248/230 X |
| 3,550,146 | 12/1970 | Eberle . | |
| 4,014,027 | 3/1977 | Reinders | 343/891 X |
| 4,338,875 | 7/1982 | Lisowksi | 248/230 X |
| 4,468,671 | 8/1984 | Ellingson et al. . | |
| 4,528,914 | 7/1985 | Montet | 248/245 X |
| 4,591,127 | 5/1986 | Tuvesson | 248/230 X |
| 5,200,759 | 4/1993 | McGinnis . | |

FOREIGN PATENT DOCUMENTS

| | | | |
|---|---|---|---|
| 654061 | 12/1962 | Canada | 343/890 |

*Primary Examiner*—Ramon O. Ramirez
*Assistant Examiner*—Derek J. Berger
*Attorney, Agent, or Firm*—Jones & Askew

[57] ABSTRACT

An antenna mounting platform for mounting at selectable positions along the length of a monopole tower comprises a frame having an interior opening for receiving the monopole, a bracket mounted to the frame and extending to the interior opening and means for selectively (1) forcing the bracket against the monopole and holding the mounting platform on a location on the monopole, and alternatively, (2) releasing the bracket from against the monopole so that the mounting platform is movable along the length of the monopole. Desirably, the antenna mounting platform comprises a plurality of connecting members corresponding to the number of brackets for connecting the brackets. Each connecting member connects adjacent brackets and is operable to selectively compress associated first and second outriggers together and thereby force the brackets against the monopole, and alternatively, decompress the associated first and second outriggers and thereby release the brackets from against the monopole.

12 Claims, 3 Drawing Sheets

ANTENNA MOUNTING PLATFORM FOR A MONOPOLE TOWER

TECHNICAL FIELD

This invention relates to antenna mounting platforms, and more particularly, relates to platforms for mounting antennas to monopole towers.

BACKGROUND OF THE INVENTION

Antennas for use in broad-ranging communication systems, such as cellular communications systems, are mounted on towers. Two types of towers for mounting antennas include lattice-type towers and monopole towers. Lattice-type towers comprise a plurality of poles arranged into lattice sections which are stacked one on top of the other to obtain the desired height. Monopole towers comprise a tubular mast.

Typically, a plurality of antennas, some transmitting antennas and some receiving antennas, are mounted on a single tower. It is desirable to be able to change the height and orientation of the antennas from time to time. This is easily accomplished on a lattice-type tower, because the antennas are mounted on removable brackets which can be relocated anywhere on the tower. Monopole towers are more limited in this regard. Antennas are typically mounted to a nonremovable platform at the top of a monopole tower. To lower the antennas on a monopole, one must replace the entire pole with a shorter one.

Accordingly, there is a need for an antenna mounting platform for a monopole tower which can be mounted at selectable positions along the length of the monopole.

SUMMARY OF THE INVENTION

This invention solves the above-described problems in the prior art by providing an antenna mounting platform comprising one or more brackets which can be selectively forced against a monopole to hold the platform at a location on the monopole, and alternatively, released from against the monopole so that the mounting platform is moveable along the length of the monopole. The antenna mounting platform of the present invention can thus be mounted at selectable positions along the length of the monopole tower.

More particularly, the antenna mounting platform of the present invention comprises a frame having an interior opening for receiving the monopole, a bracket mounted to the frame and extending into the interior opening, and a device for selectively (1) forcing the bracket against the monopole and holding the mounting platform at a location on the monopole, and alternatively (2) releasing the bracket from against the monopole so that the mounting platform is movable along the length of the monopole.

Desirably, the antenna mounting platform of the present invention comprises a plurality of brackets mounted to the frame. The plurality of brackets extend into the interior opening of the frame and are spaced about the interior of the opening so that when the antenna mounting platform is mounted to the monopole, the brackets are spaced about the circumference of the monopole. The brackets are desirably spaced about the interior opening so that when the antenna mounting platform is mounted to the monopole, the brackets are spaced substantially equidistant about the circumference of the monopole.

Still more particularly, the antenna mounting platform of the present invention comprises brackets which each comprise a base, a pair of arms spaced from one another and extending from the base toward the monopole when the interior opening receives the monopole, and first and second outriggers for mounting the base to the frame. The first and second outriggers are spaced from one another and extend between and are mounted to the base and the frame. The first outrigger of each bracket is positioned adjacent the second outrigger of an adjacent bracket. Desirably, the antenna mounting platform comprises a number of connecting members corresponding to the number of brackets for connecting the brackets. Each connecting member connects adjacent brackets. The connecting members are operable to selectively (1) compress the associated first and second outriggers together and thereby force the arms of the brackets against the monopole and hold the mounting platform at a location on the monopole, and alternatively, (2) decompress the associated first and second outriggers and thereby release the brackets from against the monopole so that the mounting platform is movable along the length of the monopole.

Each such connecting member desirably comprises a threaded rod extending between adjacent brackets, a head at one end of the rod for holding one of the adjacent brackets, and a nut threaded onto an opposite end of the rod for holding the other of the adjacent brackets. The nut is movable along the length of the rod to selectively compress the associated first and second outriggers together, and alternatively, decompress the associated first and second outriggers.

In a particularly desirable embodiment, the brackets are three in number and the frame is substantially triangular in shape. In addition, the triangular frame has corner regions and the first and second outriggers of each bracket are mounted to and extend from adjacent corner regions. Still more particularly, the frame comprises three sections of substantially equal length (an equilateral triangle) and each of the brackets are positioned adjacent one of the sections and substantially midway between adjacent corner regions. Desirably, the frame comprises a deck and a rail mounted to the deck about the periphery of the deck.

Therefore, it is an object of the present invention to provide an improved antenna mounting platform for use with monopole towers.

Another object of the present invention is to provide a platform for mounting antennas at selectable positions along the length of a monopole tower.

Still another object of the present invention is to provide a simple and economical antenna mounting platform for a monopole tower.

Other objects, features and advantages of the present invention will become apparent from the following detail description, drawings and claims.

DETAILED DESCRIPTION

Figure 1:
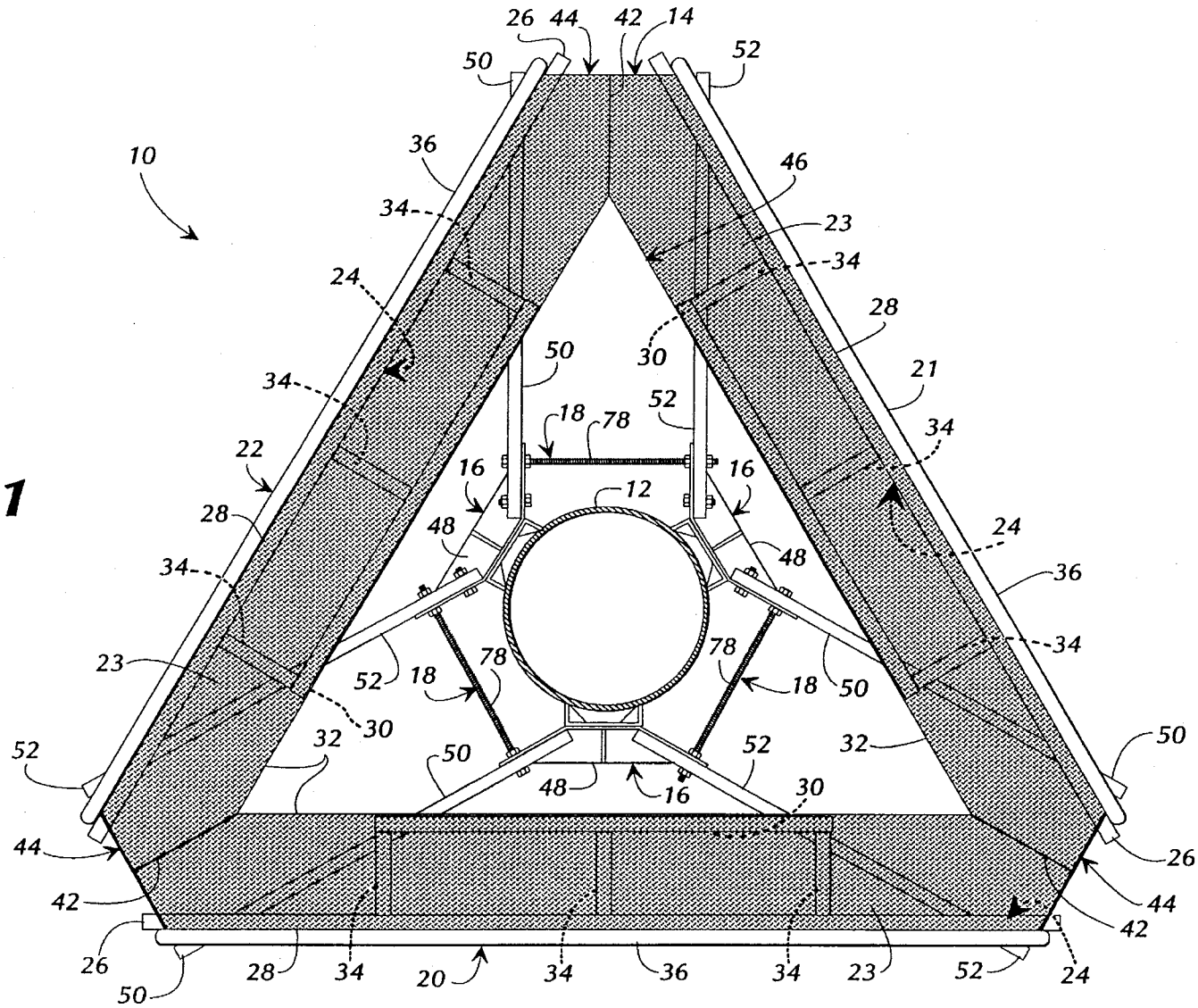
FIG. 1 is plan view of an antenna mounting platform made according to an embodiment of the present invention.

As summarized above, the present invention encompasses an antenna mounting platform for mounting at selectable positions along the length of a monopole tower. An antenna mounting platform 10 made according to an embodiment of the present invention is shown in FIG. 1 as being attached to a monopole 12. Generally described, the antenna mounting platform 10 comprises a frame 14 surrounding the monopole 12, three brackets 16 attached to the frame and spaced equidistant about the monopole, and three corresponding connectors 18 for connecting the three brackets together. The connectors 18 are operable to selectively (1) force the brackets 16 against the monopole 12 and hold the mounting platform 10 at a location on the monopole, and alternatively, (2) release the brackets from against the monopole so that the mounting platform is movable along the length of the monopole.

Figure 2:
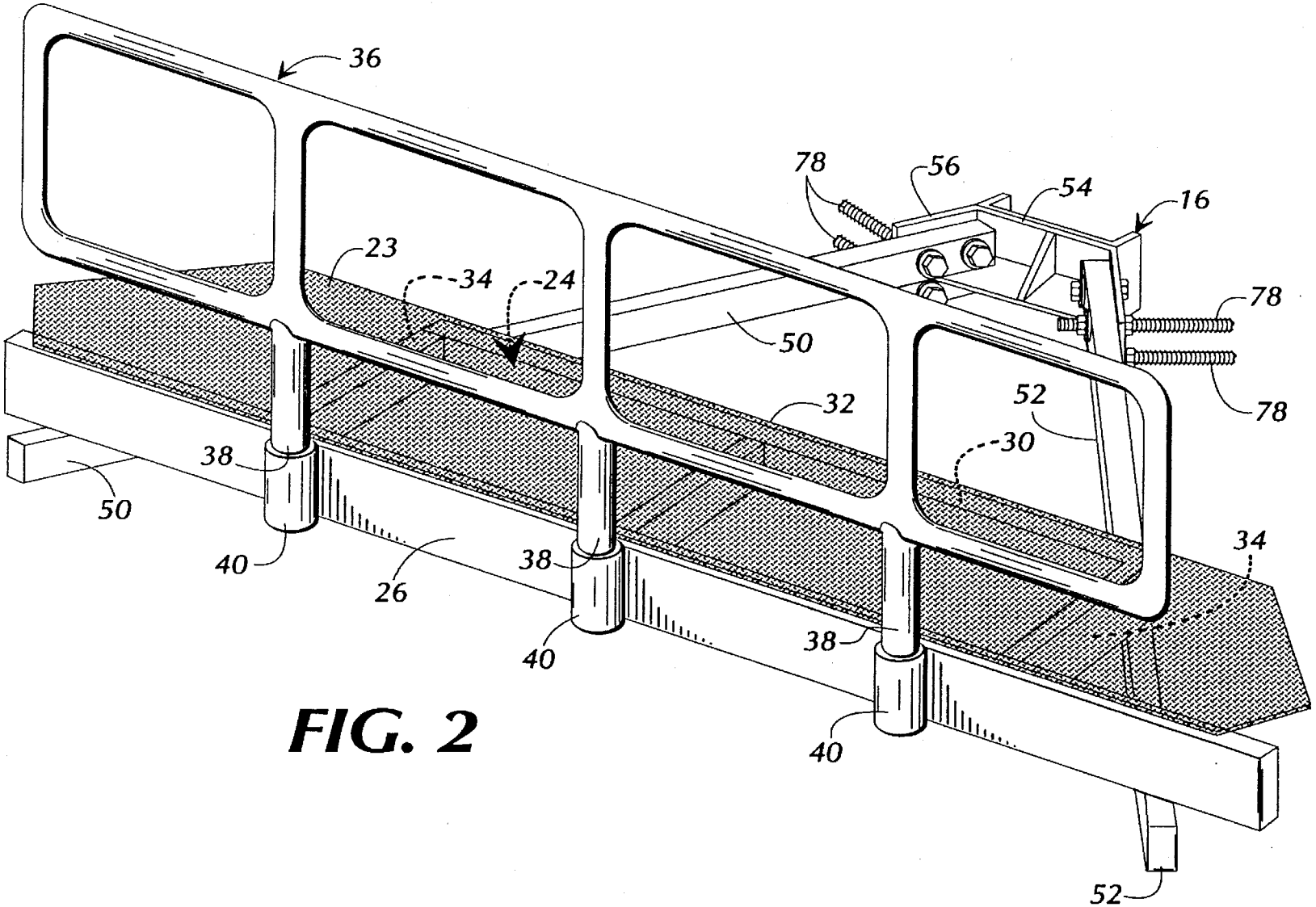
FIG. 2 is a partial perspective view of a frame section of the antenna mounting platform shown in FIG. 1.
Figure 3:
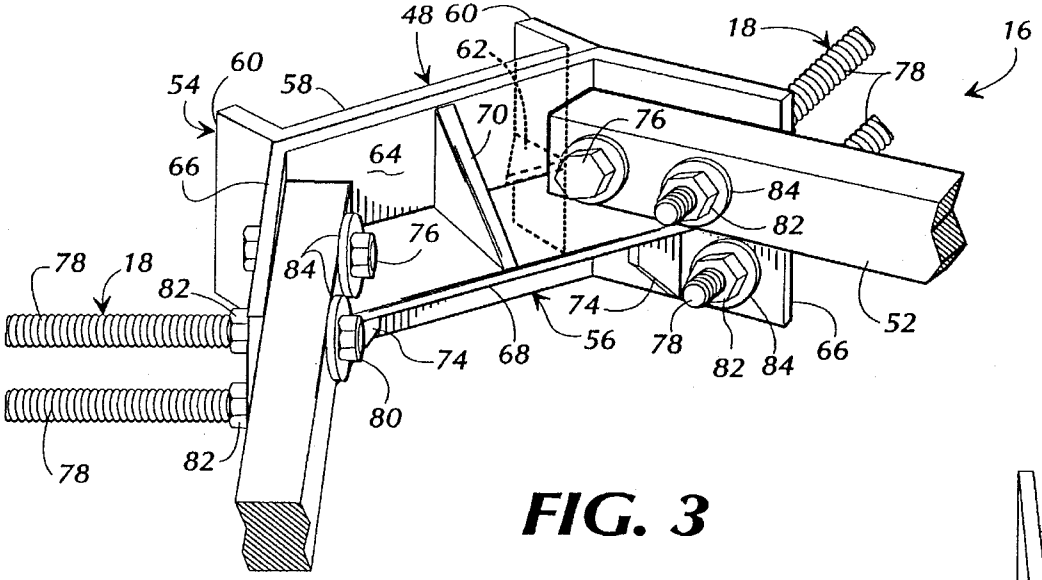
FIG. 3 is a frontal partial perspective view of one of the brackets that forms part of the antenna mounting platform shown in FIG. 1.
Figure 4:
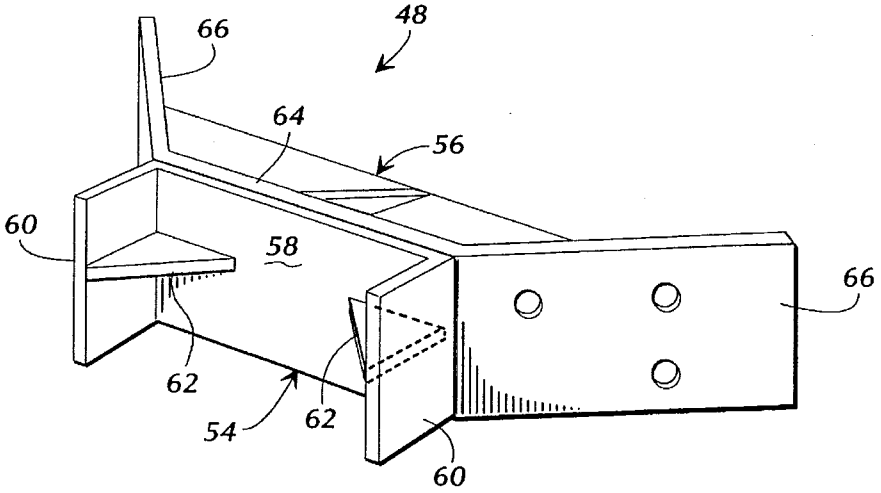
FIG. 4 is a rearward partial perspective view of one of the brackets that forms part of the antenna mounting platform, shown in FIG. 1.

The frame 14 comprises three identical sections 20, 21, and 22. Each of the sections 20, 21, and 22 comprise a deck 23 fastened to a support 24. The deck 23 provides a surface on which antennas can be mounted and is shown in FIGS. 1 and 2 as a flat, elongate sheet of metal grading. The deck 23 can be fastened to the support 24 by conventional means such as welding or bolting. The support 24 comprises a peripheral support bar 26 extending along the peripheral edge 28 of the deck 23 and an interior support bar 30 extending along the interior edge 32 of the deck. The peripheral support bar 26 and the interior support bar 30 are connected by three bars 34 extending perpendicularly between the peripheral support bar and the interior support bar beneath the deck 23. Each of the sections 20, 21, and 22 further comprises a rail 36 mounted to the peripheral support bar 26 and extending above the deck 23. The legs 38 of the rail 36 fit into sleeves 40 mounted to the peripheral support bar 26.

The sections 20, 21, and 22 of the frame 14 are fastened to one another such as by welding along seams 42 to form a triangular frame having corner regions 44 and defining a triangular interior opening 46. The frame 14 is desirably in the shape of an equilateral triangle so that the weight of the antenna mounting platform 10 is distributed evenly across the antenna mounting platform and the antenna mounting platform is balanced when mounted to the monopole 12.

The brackets 16 each comprise a base 48 and first and second outriggers 50 and 52 spaced from one another and extending between and mounted to the base and the frame 14. The first and second outriggers 50 and 52 thereby mount the base 48 of each bracket 16 to the frame 14. The first outrigger 50 of each bracket 16 is positioned adjacent the second outrigger 52 of an adjacent bracket.

The base 48 of each bracket 16 comprises a pole facing section 54 mounted to an outward facing section 56. The pole facing section 54 is U-shaped and comprises an elongated back plate 58 and a pair of arms 60 spaced from one another and extending outwardly from the elongated back plate toward the monopole 12, Each of the arms 60 is disposed at right angles to the elongated back plate 58. The distal end of each arm 60 provides a contact point with the monopole tower 12. Triangular reinforcing plates 62 extend between each arm 60 and the elongated back plate 58 of the pole facing section 54.

The outward facing section 56 of the base 48 is also U-shaped and comprises an elongated back plate 64 and a pair of legs 66 spaced from one another and extending from opposite ends of the elongated back plate outwardly from one another, Each leg 66 of the outward facing section 56 is disposed at approximately 150° with respect to the elongated back plate 64 of the outward facing section. The elongated back plate 64 of the outward facing section 56 is connected to the elongated back plate 58 of the pole facing section 54 such that the legs 66 of the outward facing section 64 extend away from the monopole tower 12.

The base 48 further comprises a central support plate 68 which extends between the legs 66 of the outward facing section 56 and along the elongated back plate 64 of the outward facing section 56 substantially along the midsection of the outward facing section. The central support plate 68 is perpendicular to the legs 66 and elongated back plate 64 of the outward facing section 56. The base also includes a reinforcing plate 70 extending upwardly between the central support plate 68 and the elongated back plate 64 of the outward facing section 56. This reinforcing plate 70 is perpendicular to and extends from the middle of both the elongated back plate 64 and central support plate 68 of the outward facing section 56. Other reinforcing plates 72 and 74 extend beneath the central support plate 68 between the central support plate and respective legs 66 of the outward facing section 56. These reinforcing plates 72 and 74 are perpendicular to the respective legs 66 and extend from the middle of those legs.

The first and second outriggers 50 ad 52 of each bracket 16 extend from and are mounted to the upper portions of respective legs 66 of the outward facing sections 56 of the brackets. The outriggers 50 and 52 are fastened to the legs 66 with bolts 76 and are disposed against the legs and the central support plate 68. The outriggers 50 and 52 extend away from the elongated back plate 64 of each outward facing section 56 at a 150° with respect to the elongated back plate.

The connectors 18 comprise pairs of threaded rods 78 extending between adjacent brackets 16. The threaded rods 78 extend through holes in the legs 66 of the outward facing sections 56 of the brackets 16. One of the threaded rods 78 of each pair of threaded rods extends through a corresponding hole in associated first and second outriggers 50 and 52 of adjacent brackets 16. The other of each pair of threaded rods 78 extends below the first and second outriggers 50 and 52 and between the legs 66 of adjacent brackets 16. A head 80 is mounted to one end of each of the threaded rods 78. The heads 80 are positioned outwardly of the respective bracket base legs 66 and first outriggers 50, with respect to the threaded rods 78. The heads 80 of the upper threaded rods 78 hold the first outriggers 50 against the respective legs 66 of the bracket bases 48. The connectors 18 further comprise nuts 82 threaded onto the threaded rods 78 and positioned proximate the opposite end of the threaded rods from the heads 80 and outwardly of the second outriggers 52, with respect to the threaded rods, and inwardly of the first and second outriggers 50 and 52 and the legs 66, with respect to the threaded rods. The nuts 82 are movable along the length of the threaded rods 78 to selectively compress the associated first and second outriggers 50 and 52 together, and alternatively, decompress the first and second outriggers. When the first and second outriggers 50 and 52 are compressed, the arms 60 of the brackets 16 are forced against the monopole 12 and hold the mounting platform 10 at a desired location on the monopole. When the first and second outriggers 50 and 52 are decompressed, the brackets 16 are released from against the monopole 12 so that the mounting platform is movable along the length of the monopole. The connectors 18 also include washers 84 between the heads 80 and nuts 82 and the outriggers 50 and 52 and legs 66.

The first and second outriggers 50 and 52 extend from the bracket bases 42 to respective comer regions 44 of the frame 14. The first and second outriggers 50 and 52 are mounted to the peripheral support bars 26 and interior support bars 30 of the frame 14 at the corner regions 44 of the frame. The outriggers 50 and 52 are mounted to the frame 14 by conventional methods such as welding or bolting. Each of the brackets 16 are positioned adjacent one of the sections 20, 21, 22 of the frame 14 substantially midway between adjacent corner regions 44. The first and second outriggers 50 and 52 of a particular bracket 16 extend toward adjacent corner regions 44 and not the same corner region. The bracket 16 and first and second outriggers 50 and 52 are positioned such that when the mounting antenna platform 10 is mounted to the monopole 12, the first and second outriggers of adjacent brackets extend parallel to one another toward the same corner region 44. The arrangement provides for a balanced antenna mounting platform.

When the antenna mounting platform 10 is to be mounted about the monopole tower 12, the nuts 82 on the threaded rods 78 of the connectors 18 are loosened and the antenna mounting platform is placed about the circumference of the monopole tower 12, so that the monopole tower 12 is received within the interior opening 46 of the frame 14. The antenna mounting platform 10 is moved along the length of the monopole tower 12 until the desired location for the antenna mounting platform is reached. The nuts 82 on the threaded rods 78 are then tightened until the bracket arms 60 are forced firmly against the monopole tower 12 and the antenna mounting platform is held firmly in place against the monopole tower. Antennas can then be mounted on the deck 23 and the rail 36 of the frame 14. When it is desirable to move the location of the antenna mounting platform 10 along the length of the monopole tower 12, the nuts 82 are again loosened and the antenna mounting platform is moved.

It should be understood that the foregoing relates to particular embodiments of the present invention, and the numerous changes may be made therein without departing from the scope and spirit of the invention as defined by the following claims.

I claim:

1. An antenna mounting platform for mounting at selectable positions along the length of a monopole tower comprising:

a frame having an interior opening for receiving the monopole;

a plurality of brackets mounted to the frame and extending into the interior opening, the brackets being spaced about the interior opening so that when the antenna mounting platform is mounted to the monopole, the brackets are spaced about the circumference of the monopole, the brackets each comprising:

a base;

a pair of arms spaced from one another and extending from the base toward the monopole when the interior opening receives the monopole; and first and second outriggers spaced from one another and extending between and mounted to the base and the frame so that the first and second outriggers mount the base to the frame and the first outrigger of each bracket is positioned adjacent the second outrigger of an adjacent bracket; and a number of connecting members corresponding to the number of brackets for connecting the brackets, each connecting member connecting adjacent brackets and being operable to selectively (1) compress the associated first and second outriggers together and thereby force the arms of the brackets against the monopole and hold the mounting platform at a location on the monopole, and alternatively, (2) decompress the associated first and second outriggers and thereby release the brackets from against the monopole so that the mounting platform is movable along the length of the monopole.

2. An antenna mounting platform as in claim 1 wherein each connecting member comprises:

a threaded rod extending between adjacent brackets;

a head at one end of the rod for holding one of the adjacent brackets; and a nut threaded onto an opposite end of the rod for holding the other of the adjacent brackets and being movable along the length of the rod to selectively compress the associated first and second outriggers together, and alternatively, decompress the associated first and second outriggers.

3. An antenna mounting platform as in claim 1 wherein each connecting member connects the first outrigger of one bracket to the second outrigger of an adjacent bracket and extends between the associated first and second outriggers proximate the brackets.

4. An antenna mounting platform as in claim 3 wherein each connecting member comprises:

a threaded rod extending between the associated first and second outriggers and through passages in the associated first and second outriggers;

a head at one end of the rod and positioned outwardly of one of the associated first and second outriggers for holding one of the associated first and second outriggers; and a nut threaded onto an opposite end of the rod outwardly of the other of the associated first and second outriggers and being movable along the length of the rod to selectively compress the associated first and second outriggers together, and alternatively, decompress the associated first and second outriggers.

5. An antenna mounting platform as in claim 1 wherein the brackets are spaced about the interior opening so that when the antenna mounting platform is mounted to the monopole, the brackets are spaced substantially equidistant about the circumference of the monopole.

6. An antenna mounting platform as in claim 5 wherein the brackets are three in number.

7. An antenna mounting platform as in claim 6 wherein the frame is substantially triangular in shape.

8. An antenna mounting platform as in claim 7 wherein the triangular frame has comer regions and the first and second outriggers of each bracket are mounted to and extend from adjacent comer regions.

9. An antenna mounting platform as in claim 8 wherein the triangular shape of the frame is equilateral.

10. An antenna mounting platform as in claim 9 wherein the frame comprises three sections of substantially equal length and each of the brackets are positioned adjacent one of the sections and substantially midway between adjacent corner regions.

11. An antenna mounting platform as in claim 1 wherein the frame comprises a deck.

12. An antenna mounting platform as in claim 11 wherein the deck has a periphery and the frame further comprises a rail mounted to the deck about the periphery of the deck.

* * * * *